US011655512B2

(12) United States Patent
Li et al.

(10) Patent No.: US 11,655,512 B2
(45) Date of Patent: May 23, 2023

(54) RARE-EARTH MICROALLOYED STEEL AND CONTROL METHOD

(71) Applicant: INSTITUTE OF METAL RESEARCH CHINESE ACADEMY OF SCIENCES, Liaoning (CN)

(72) Inventors: Dianzhong Li, Liaoning (CN); Yikun Luan, Liaoning (CN); Pei Wang, Liaoning (CN); Xiaoqiang Hu, Liaoning (CN); Paixian Fu, Liaoning (CN); Hongwei Liu, Liaoning (CN); Lijun Xia, Liaoning (CN); Chaoyun Yang, Liaoning (CN); Hanghang Liu, Liaoning (CN); Hang Liu, Liaoning (CN); Yiyi Li, Liaoning (CN)

(73) Assignee: INSTITUTE OF METAL RESEARCH CHINESE ACADEMY OF SCIENCES, Shenyang (CN)

( * ) Notice: Subject to any disclaimer, the term of this patent is extended or adjusted under 35 U.S.C. 154(b) by 0 days.

(21) Appl. No.: 17/641,732

(22) PCT Filed: Sep. 29, 2019

(86) PCT No.: PCT/CN2019/108857
§ 371 (c)(1),
(2) Date: Mar. 9, 2022

(87) PCT Pub. No.: WO2021/046937
PCT Pub. Date: Mar. 18, 2021

(65) Prior Publication Data

US 2022/0307097 A1 Sep. 29, 2022

(30) Foreign Application Priority Data

Sep. 10, 2019 (CN) ..... 201910854347.5

(51) Int. Cl.

| | |
|---|---|
| ***C21C 7/00*** | (2006.01) |
| ***C21C 7/10*** | (2006.01) |
| ***C22C 33/04*** | (2006.01) |
| ***C22C 38/06*** | (2006.01) |
| ***C22C 38/04*** | (2006.01) |
| ***C22C 38/02*** | (2006.01) |
| ***C22C 38/00*** | (2006.01) |

(52) U.S. Cl.
CPC ..... *C21C 7/0006* (2013.01); *C21C 7/10* (2013.01); *C22C 33/04* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01)

(58) Field of Classification Search
None
See application file for complete search history.

(56) References Cited

FOREIGN PATENT DOCUMENTS

| | | | |
|---|---|---|---|
| CN | 1475580 A | * | 2/2004 |
| CN | 1475580 A | | 2/2004 |
| CN | 106521293 A | | 3/2017 |
| CN | 109648064 A | | 4/2019 |
| RU | 2010126855 A | | 1/2012 |

OTHER PUBLICATIONS

International Search Report of PCT/CN2019/108857.
Written Opinion of PCT/CN2019/108857.
Fu, Xiaoyang, "The Action Mechanisms of RE Element in Steel and Its Study on Current Status", vol. 31. No. 1, Feb. 28, 2015, Hunan Nonferrous Metals.

* cited by examiner

*Primary Examiner* — Anthony M Liang
(74) *Attorney, Agent, or Firm* — Dragon Sun Law Firm, PC; Nathaniel Perkins

(57) ABSTRACT

Provided in the present application are a rare-earth microalloyed steel and a control process. The steel has a special microstructure, and the microstructure comprises a rare earth-rich nanocluster having a diameter of 1-50 nm. The nanocluster has the same crystal structure type as a matrix. The rare earth-rich nanocluster inhibits the segregation of the elements S, P and As on a grain boundary, and obviously improves the fatigue life of the steel. In addition, a rare-earth solid solution also directly affects a phase change dynamics process so that the diffusion-type phase change starting temperature in the steel changes at least to 2° C., and even changes to 40-60° C. in some kinds of steel, thereby greatly improving the mechanical properties thereof, and providing a foundation for the development of more kinds of high-performance steel.

20 Claims, 3 Drawing Sheets

RARE-EARTH MICROALLOYED STEEL AND CONTROL METHOD

CROSS-REFERENCE TO RELATED APPLICATIONS

This application is a national stage application of PCT/CN2019/108857. This application claims priorities to PCT Application No. PCT/CN2019/108857, filed Sep. 29, 2019, and Chinese Patent Application No. CN201910854347.5, entitled "Rare-Earth Microalloyed Steel and Control Method" filed on Sep. 10, 2019 to China Patent Office, the entire contents of which are incorporated herein by reference.

TECHNICAL FIELD

The present application belongs to the field of alloy and special steel preparation, and relates to a rare-earth microalloyed steel and a control method.

BACKGROUND ART

The research and development of rare earth elements and rare-earth steels have a long history in the field of metallurgy. The addition of rare earth elements (such as La, Ce, etc.) has an effective purification effect on the deoxidation and desulphurization of molten steel, and also performs noticeably well in the modification of inclusions and microalloying. Sometimes, these effects lead to better properties, such as improved toughness, plasticity, heat and corrosion resistances, and wear resistance, but sometimes lead to performance deterioration. Sometimes good, sometimes bad. There are serious fluctuations in the mechanical properties of rare-earth microalloyed steels. In the last decade, with the application of the double low oxygen technology, i. e. the simultaneous control of the initial oxygen content of the rare earth metal itself and the total oxygen content of the molten steel, the roles of the rare earth elements become exceptionally stable and prominent. Relevant technologies are presented in some applications, as represented by many of the prior applications of the inventors, such as CN201610265575.5, relating to a method for preparing a high-purity rare earth metal; CN201611144005.7, relating to an ultra-low oxygen rare earth alloy and its use; CN201410141552.4, relating to a smelting method for an ultra-low oxygen clean steel, which uses two-times vacuum carbon deoxidation in combination with rare earth elements addition to further deoxidize and reduce the oxygen content of the molten steel; CN201610631046.2, relating to a method for improving the performance of a steel by adding the rare earth metal, in which the problem of nozzle clogging is solved by simultaneously controlling the T[O]s<20 ppm of molten steel before adding the rare earth and the T[O]r<60 ppm of rare earth metal itself, so as to purify inclusions and improve the impact toughness of the steel; CN201710059980.6, relating to a treating method for a high-purity rare-earth steel, in which the amount of rare earth elements is added according to the dissolved oxygen $O_{dissolved\ oxygen}$, total oxygen T.O, sulphur content S in the molten steel, the basicity R=CaO/$SiO_2$ of the refining slag and the total content of FeO+MnO. In the invention 201811319185.7 of Cheng Guoguang et al. from University of Science and Technology Beijing, $MgAl_2O_4$ in the bearing steel is modified into specific $Ce_2O_2S$ or $Ce_2O_2S$ by adding an appropriate amount of rare earth element of Ce, then heterogeneous nucleation and precipitation of TiN is inhibited on the $MgAl_2O_4$ during solidification, so as to improve the cleanliness and fatigue life of the bearing steel.

In addition, some journals (e. g. "Influence of Cerium on Inclusions in 1Cr17 Stainless Steel", *Chinese Rare Earth,* 2010) indicate that rare earth elements can react with O and S to form $RE_2O_2S$ or $RE_2S_3$ when Ce content in 1Cr17 stainless steel is 0.12%-0.18%. However, the understanding of rare earth element still remains in its influence on the size and morphology of inclusions.

The effect of rare earth elements on the microstructure of steel is rarely involved in the prior art. The influential mechanism of rare earth elements on the properties of steel has not been studied in depth and systematically, even if the effect of rare earth elements on the microstructure of steel is involved. The lack of systematic guidance on the process operation of adding rare earth into steel restricts the application of low-cost rare earth in the preparation of high-performance steel, such as high-end bearing steel, gear steel, die steel, stainless steel, nuclear power steel, automobile steel and various key parts.

SUMMARY OF THE INVENTION

In order to obtain the influence mechanism of rare earth elements on the properties of steel, so as to guide or apply it to the development of high-performance steel varieties in industrial scale production, this application proposes a rare-earth microalloyed steel and a control method thereof. To this end, the present invention provides the following technical solutions.

In one aspect, embodiments herein provide a rare-earth microalloyed steel having a microstructure therein, the aforementioned microstructure comprises rare earth-rich nanoclusters with diameters of 1-50 nm, preferably 2-50 nm, more preferably 2-4 nm, 2-30 nm, 5-50 nm or 5-20 nm.

The rare earth-rich nanoclusters are nanoscale particle groups formed by the aggregation of several to hundreds of rare earth atoms, and such a rare earth-rich particle group is referred to as a rare earth-rich nanocluster. The vacancies in the Fe matrix form rare earth-vacancy pairs with a number of rare earth atoms, so that a number of rare earth atoms are regularly arranged around the vacancies, thereby forming rare earth-rich nanoclusters. These nanoclusters have the same type of crystal structure as the Fe matrix, but have significant lattice distortion compared to the matrix.

Crystal structure refers to the most basic structural features of a crystal in which atoms, ions and molecules present three-dimensional periodic regular arrangement in space. Typical crystal structures include face-centered cubic (FCC), body-centered cubic (BCC), hexagonal close-packed (HCP), etc.

The rare earth-rich nanoclusters are solid solution rare earth elements; the rare earth-rich nanoclusters inhibit the segregation of the S, P and As elements on the grain boundaries, so that the grain boundary segregation of rare earth elements is greater than that inside the grains; instead the segregation of the S, P and As elements inside the grains is greater than that on the grain boundaries.

The study found that, for RE in bcc-Fe or fcc-Fe, the substitutional solid solution enthalpies of Ce and La are big positive values with 2.79 eV and 1.47 eV in bcc Fe and 3.39 eV and 1.73 eV in fcc Fe respectively. However, when RE atoms exist adjacent to Fe vacancies, the solid solution enthalpies of La and Ce in bcc Fe decrease to −1.84 eV and −1.56 eV, respectively; that is to say, the presence of vacancies facilitates the formation of rare earth-rich nanoclusters, and the presence of a single Fe vacancy can help to stabilize local nanoclusters consisting of up to 14 rare earth atoms, thereby forming a microstructure containing the above-mentioned features. In addition, RE elements are easy to dissolve in the lattice defects and/or voids, which inhibits the segregation of impurity elements S, P and As on the grain boundaries, so that the segregation amount of RE-rich nanoclusters on the grain boundaries is greater than that in the grain interior, and the segregation amount of impurity elements S, P and As inside the grains is greater than that on the grain boundaries.

Preferably, the addition amount of rare earth elements in the RE-microalloyed steel of the present application satisfies the following inequality $W_{RE}>\alpha\times T[O]_m+T[S]$, wherein a has a value of 6-30, preferably 8-20; $T[O]_m$ is the total oxygen content in the steel, and T[S] is the total sulfur content in the steel; and the residual amount T[RE] of rare earth elements in the steel is 30-1000 ppm, preferably 30-600 ppm, more preferably 50-500 ppm.

Preferably, the diameter of the rare earth-rich nanoclusters is directly proportional to the residual amount T[RE] of rare earth elements in the steel, but inversely proportional to the total oxygen content in the steel.

The research shows that the solid solution of RE elements has a direct effect on the dynamic process of phase transition. The initial temperature of diffusion-type phase transition (including the initial temperature of ferrite phase transition, etc.) of the steel with RE addition changes by at least 2° C., and some steel grades even decrease by 40-60° C., which will greatly improve the hardenability of the steel and affect the mechanical properties of the steel. This is the first observation that RE addition in the ppm level can cause such a large change in the phase transition temperature in the steel.

The reason is that the carbon diffusion has the largest effect on the diffusion-type phase transition process in steel. The addition of only ppm level of RE elements leads to the increase of energy barrier of carbon diffusion. More importantly, the addition of RE elements not only affects the migration energy barrier of carbon atoms at the most adjacent gap position, but also has a great effect on the migration energy barrier of carbon atoms at the second/third adjacent gap position, thus significantly slowing down the diffusion of carbon. However, at a relatively fast cooling rate, there is not enough time for carbon diffusion to take place during the phase transition, thus the effect of RE elements on the phase transition is very significant, so that such a low content of RE elements can effectively lead to a significant change of the initial temperature in the phase transition, and finally to an important change in the microstructure and mechanical properties, playing a significant microalloying effect.

The analysis shows that the addition of the above ppm level of RE elements to different types of steel results in different effects on the change of the phase transition temperature, as shown in Table 1 below.

| Types | Change in initial temperature of phase transition/° C. |
|---|---|
| Plain carbon steel | At least 2° C., preferably 10-50° C. |
| Low alloy steel with an alloy content of not more than 10 wt % | At least 5° C., preferably 20-60° C. |
| Medium-high alloy steel with an alloy content of more than 10 wt % | At least 10° C., preferably 25-60° C. |

Preferably, the initial temperature of ferrite phase transition in rare-earth microalloyed plain carbon steel decreases by 20-50° C.; and the initial temperature of bainite transformation in rare-earth microalloyed low alloy steel decreases by 30-60° C.

Preferably, the number and diameter of the rare earth-rich nanoclusters in the rare-earth microalloyed steel are directly proportional to the change of the initial temperature of the phase transition.

A microstructure control process for the rare-earth microalloyed steel of the present application is that the vacancies in the Fe matrix form rare earth-vacancy pairs with a number of rare earth atoms, so that a number of rare earth atoms around the vacancies are regularly arranged, thereby forming a microstructure of rare earth-rich nanoclusters; in which, the presence of a single Fe vacancy helps stabilize local rare earth-rich nanoclusters consisting of up to 14 rare earth atoms. On the other hand, the control points for the preparation of the rare-earth microalloyed steel described in the present application are as follows.

(1) The total oxygen content $T[O]_m$ in the mother liquor of molten steel is controlled to be within 50 ppm, preferably within 25 ppm, by means of, but not limited to, Al deoxidation, silicon manganese deoxidation, titanium deoxidation, vacuum deoxidation and the like.

(2) A rare earth mischmetal having a total oxygen content T[O]r of less than 60 ppm is added to the mother liquor of molten steel, wherein the addition amount of the rare earth mischmetal satisfies $W_{RE}>\alpha\times T[O]_m+T[S]$, and the value of $\alpha$ is 6-20, preferably 8-15; $T[O]_m$ is the total oxygen content in the steel, and T[S] is the total sulfur content in the steel; the temperature of the liquid steel when the rare earth elements are added is 20-100° C. above the liquidus line Tm of molten steel; preferably, the rare earth mischmetal is added in one time or step by step in two or more times; when the addition amount of rare earth is large, the stepwise addition method is selected, and the time interval between the two steps of rare earth additions is not less than 1 minute and not more than 10 minutes; preferably, the RH or VD deep vacuum cycle time after the addition of the high-purity rare earth mischmetal is ensured to be more than 10 min, and the Ar gas soft blowing time is controlled to be more than 15 min.

(3) The molten steel containing rare earth mischmetal is protected from air, and the burning loss amount of rare earth mischmetal is controlled after adding the rare earth mischmetal into the mother liquor of molten steel, so that the residual amount of rare earth elements in the mother liquor of molten steel reaches 30-1000 ppm.

The present application has the following prominent technical effects:

(1) For the first time, it is clear that the rare earth elements in the microalloyed steel is in the form of solution RE-rich nanoclusters, and it inhibits the segregation of impurity elements such as S, P and As on the grain boundaries, which significantly improves the properties of the steel and provides an important basis for the research, development and innovation of the rare-earth microalloyed steel.

(2) For the first time, it is found that the solid solution of rare earth elements directly affects the phase transition kinetics process. When only ppm level of RE is added, the initial temperature of diffusion-type phase transition changes by at least 2° C., and even from 25° C. to 60° C. in some steel grades, which greatly improves the hardenability of steel and affects its mechanical properties, providing the bases for the development of more high-performance steel grades with RE addition.

(3) By studying the size, structure and distribution characteristics of rare earth-rich nanoclusters in the steel, it is found that the size of rare earth-rich nanoclusters is directly proportional to the residual amount T[RE] of rare earth elements in the steel, but inversely proportional to the total oxygen content in the steel. The number and diameter of rare earth-rich nanoclusters in the steel are directly proportional to the change of the initial temperature of the phase transition. The semi-quantitative research results provide scientific guidances for rare earth addition to many different types of steels to develop high-end steel process operations, which is suitable for popularization and application, and has broad prospects and application value.

BRIEF DESCRIPTION OF THE DRAWINGS

FIG. 1(*b*) is a diffraction pattern of an area A in FIG. 1(*a*);

FIG. 1(*c*) is a diffraction pattern of an area B in FIG. 1(*a*);

DETAILED DESCRIPTION OF THE INVENTION

The present application is described in further details below with reference to specific embodiments, but the scope of protection of the present application is not limited thereto.

Embodiment 1

A rare earth microalloying method for plain carbon steel has a production process route being vacuum induction melting (VIM)→ingot casting→forging→rolling, including the following steps:

(1) Raw materials such as pure iron, Mn—Fe and Si—Fe are preferably selected, with the purity of the raw materials controlled, and the raw materials are smelted in a vacuum induction melting (VIM) furnace; the selection of raw materials ensures that the total oxygen content of the metal mother liquor after melting down is less than 25 ppm; the VIM process is performed by using 30% power*0.1-0.5 h, 50% power*0.2-0.5 h and 80% power, respectively; after the metal smelting in the crucible, the temperature is measured by a thermocouple; when the temperature is more than 1560° C., a high-purity rare earth mischmetal (mainly La—Ce alloy) is added into a vacuum chamber, wherein T[O]r in the rare earth alloy is less than 60 ppm, and the particle size of the rare earth mischmetal is 1-10 mm; when a rare earth mischmetal is added, the molten steel has a total oxygen content of $T[O]_m \leq 25$ ppm and a total sulfur content of $T[S] \leq 50$ ppm, and is further cast into a steel ingot; wherein, the rare earth mischmetal has an addition amount of $W_{RE} > \alpha \times T[O]_m + T[S]$.

(2) The above-mentioned steel ingot is forged into a rectangular bar with a cross section of 50 mm*80 mm, and then the bar is heated to 1170-1210° C. and rolled into a plate with a thickness of 3-8 mm.

(3) Their composition (shown in Table 2), structure and properties are sampled and tested.

TABLE 2

Composition of steels of Comparative Example 1 and Embodiment 1

| Steel | C | Si | Mn | T[S] | P | Als | T[O] | H | N | T[La] | T[Ce] |
|---|---|---|---|---|---|---|---|---|---|---|---|
| Comparative Example 1 | 0.12-0.25 | 0.1-0.4 | 1.2-1.9 | ≤0.005 | ≤0.005 | 0.0015-0.0085 | ≤25 ppm | ≤1.0 ppm | 10-30 ppm | — | — |
| Embodiment 1 | 0.12-0.25 | 0.1-0.4 | 1.2-1.9 | ≤0.005 | ≤0.005 | 0.0015-0.0085 | ≤25 ppm | ≤1.0 ppm | 10-30 ppm | 0.012 | 0.024 |

Note:

in Table 1, all the components except O, H and N being in ppm by weight are in % by weight, and the balances are Fe and inevitable impurity elements. In Comparative Embodiment 1, no rare earth elements are added.

Figure 1:
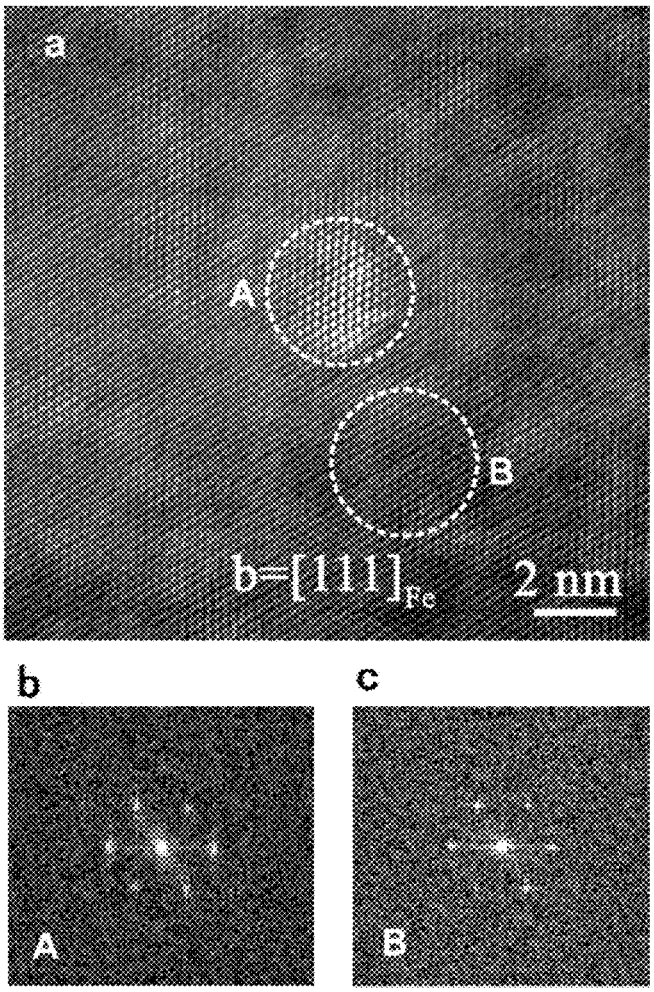
FIG. 1(*a*) is a high resolution HAADF-STEM image of a phase in the RE microalloyed steel of Embodiment 1 in the present application.
Figure 2:
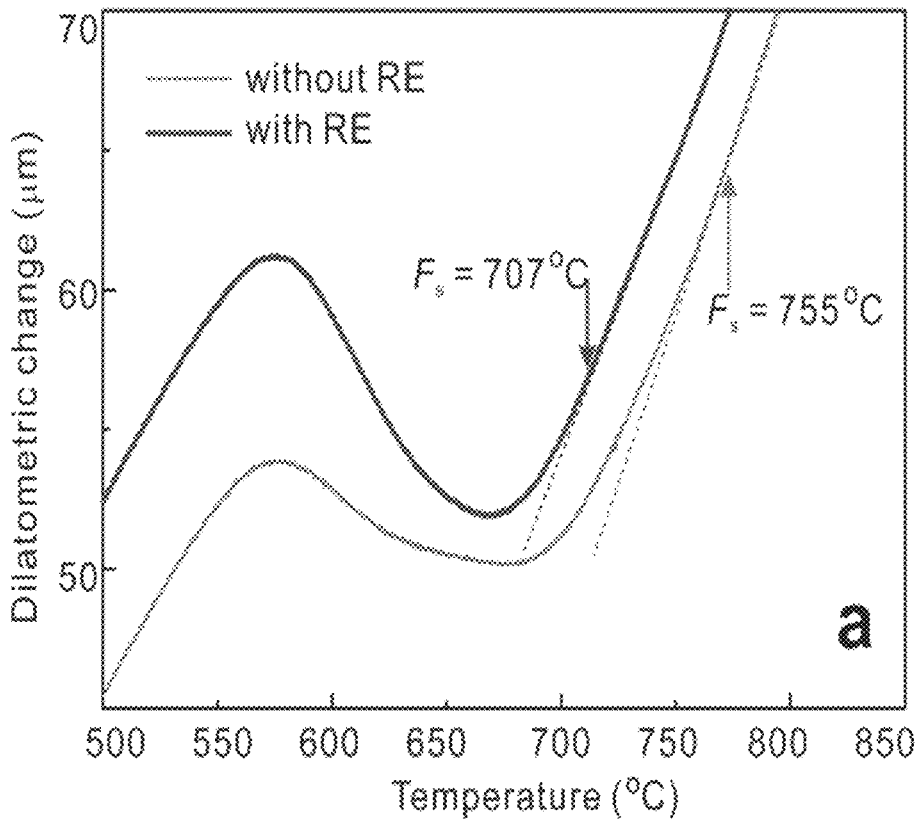
FIG. 2 shows effects of solid solution rare earth elements on the initial temperature (Fs) of ferrite phase transition in the RE microalloyed steel of Embodiment 1 at a cooling rate of 2.5° C./s.

High-brightness rare earth-rich nanoclusters with radii of 2-4 nm are also observed experimentally by the characterization of high-resolution High Angle Annular Dark Field (HAADF) of a spherical aberration-corrected electron transmission microscope, as shown by a closed circle A in FIG. 1(*e*). As shown in FIG. 1(*f*), these nanoclusters are isostructural with bcc Fe (FIG. 1(*g*)), but there is significant lattice distortion to the Fe matrix. FIG. 2(*a*) shows that, at a cooling rate of 2.5° C./s, the initial temperature (Fs) of the ferrite phase transition of RE microalloyed steel decreases from 755° C. to 707° C. when the RE content is 360 ppm (i. e. the total amount of La and Ce rare earth elements) in the RE microalloyed steel, that is to say, the initial temperature decreases by 48° C., which greatly improves the hardening ability of the steel, thus affecting its mechanical properties. Analytically, it is concluded that the addition of RE elements not only results in higher diffusion energy barrier, but also affects the migration energy barrier of carbon atoms at the most adjacent gap position; and it also has a great effect on the migration energy barrier of carbon atoms at the second/third adjacent gap positions, thus significantly slowing down the diffusion of carbon atoms. At a cooling rate of 2.5° C./s, when the RE content is 360 ppm, the decrease in Fs is close to 48° C. [FIG. 2(*a*)], mainly because there is not enough time for carbon atoms to diffuse by the phase transition process at such a fast cooling rate; and the effect of RE elements on carbon diffusion is very significant, and such a low solubility of RE elements can effectively lead to a significant change in the temperature of Fs, eventually leading to important changes in the microstructure and mechanical properties.

Embodiment 2

A rare earth microalloying method for a low alloy steel has a production process route being LF smelting→VD refining→continuous casting, including the following steps.

(1) Al deoxidation at LF station+diffusion deoxidation. The slag alkalinity is controlled to be more than 4.5, and the white slag is kept for more than 30 min, so as to carry out deep deoxidation and desulphurization, making the total sulphur content not more than 15 ppm and the total oxygen content not more than 25 ppm, further achieving more solid solution after adding the rare earth elements.

(2) After LF refining and before VD treatment, a rare earth mischmetal is added into the ladle via the slag layer (T[O]r<60 ppm in the rare earth mischmetal); the addition amounts of the rare earth mischmetal in Embodiments 2A and 2B are 300 ppm and 680 ppm respectively; and the temperature of the molten steel before adding the rare earth mischmetal is controlled at 1550° C. or above.

(3) After rare earth addition, the VD deep vacuum time is not less than 15 min; and the soft blowing time after breaking VD vacuum is not less than 15 min.

(4) In the continuous casting process, the whole nitrogen increasing amount of the large ladle-tundish-crystallizer is controlled to be no more than 5 ppm so as to prevent rare earth burning caused by secondary oxidation;

(5) The continuous casting samples (shown in Table 3) are analyzed by its composition (shown in Table 3), structure and performances.

TABLE 3

Composition of steels of Comparative Example 2 and Embodiment 2

| Steel | C | Si | Mn | Cr | Mo | V | P | T[S] | T[RE] | T[O] |
|---|---|---|---|---|---|---|---|---|---|---|
| Comparative Example 2 | 0.10-0.18 | 0.03-0.15 | 0.45-0.65 | 1.8-2.6 | 0.6-1.2 | 0.2-0.3 | ≤0.008 | ≤0.0015 | — | ≤25 |
| Embodiment 2A | 0.10-0.18 | 0.03-0.15 | 0.45-0.65 | 1.8-2.6 | 0.6-1.2 | 0.2-0.3 | ≤0.008 | ≤0.0015 | 0.020 | ≤25 |
| Embodiment 2B | 0.10-0.18 | 0.03-0.15 | 0.45-0.65 | 1.8-2.6 | 0.6-1.2 | 0.2-0.3 | ≤0.008 | ≤0.0015 | 0.048 | ≤25 |

Note:
all the components except O being in ppm by weight are in % by weight, and the balances are Fe and inevitable impurity elements. In Comparative Embodiment 2, no rare earth elements are added.

Figure 3:
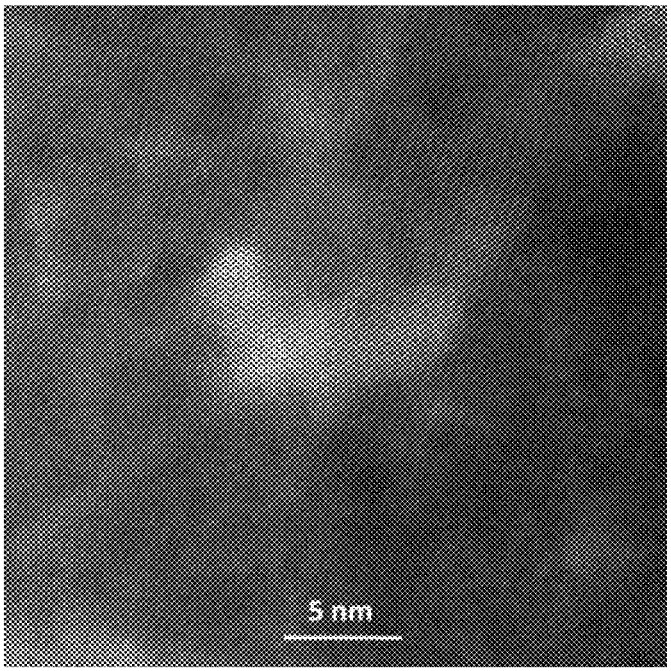
FIG. 3 shows a high resolution HAADF-STEM image of a phase in the RE microalloyed steel of Embodiment 2 herein.

High-brightness rare earth-rich nanoclusters with sizes of 4-8 nm are also observed experimentally in the sample of Embodiment 2A (rare earth elements of 200 ppm) by the characterization of high-resolution High Angle Annular Dark Field (HAADF) of a spherical aberration-corrected electron transmission microscope, as shown in FIG. 3. The high-resolution images show that these nanoclusters are isostructural with the bcc matrix but have obvious lattice distortion to the Fe matrix.

Figure 4:
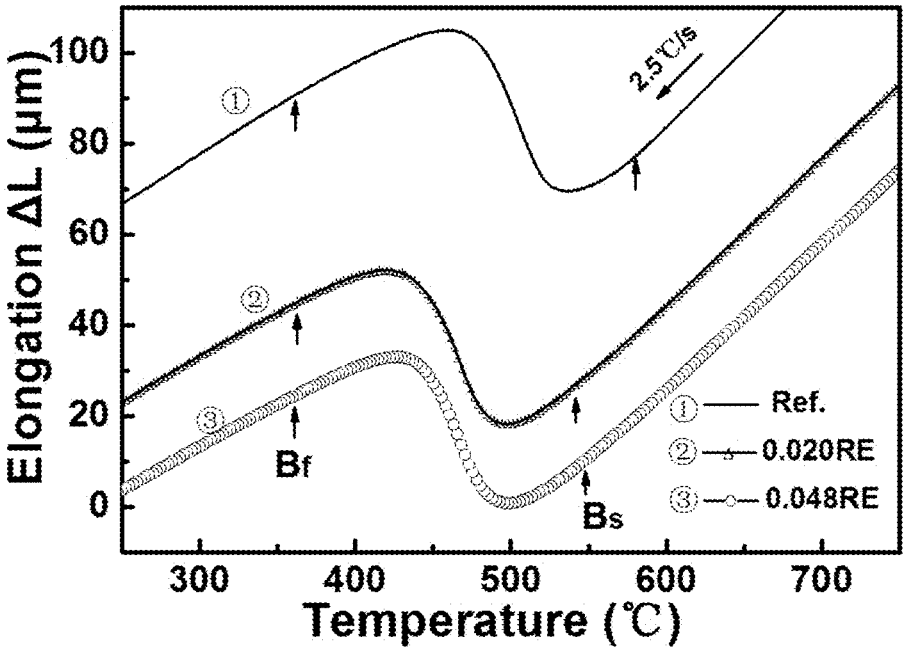
FIG. 4 shows effects of solid solution rare earth elements on the initial temperature of the phase transition of granular bainite in the RE microalloyed steel of Embodiment 2 at a cooling rate of 2.5° C./s.

FIG. 4 shows that, at a cooling rate of 2.5° C./s, with residual RE contents of 200 ppm and 480 ppm, the initial temperature of the phase transition of granular bainite in the RE microalloyed steel decreases from 573° C. to 536° C. and 543° C.; and the reduction of the initial temperature closes to 37° C. and 30° C., respectively, which will greatly improves the hardening ability of the steel, thus affecting its mechanical properties. The reason is that the addition of RE elements not only results in a higher diffusion energy barrier, but more importantly affects the migration energy barrier of carbon atoms at the most adjacent gap position; and it also has great effects on the migration energy barrier of carbon atoms at the second/third adjacent gap positions, thus significantly slowing down the diffusion of carbon atoms.

Embodiment 3

A rare earth microalloying method for a low-alloy steel has a production process route being LF smelting→RH refining→ingot casting→forging, including the following steps:

(1) The alloy composition is adjusted at the LF station. The slag alkalinity is controlled to be more than 5, and the white slag is kept for more than 40 min, so as to carry out deep deoxidation and desulphurization, making the oxygen and sulfur contents both less than 20 ppm.

(2) After LF refining, when the vacuum degree of RH treatment reaches 200 Pa or less, a rare earth mischmetal (T[O]r<60 ppm in the rare earth mischmetal) is directly added into the molten steel by the RH overhead storage bin; the addition amounts of the rare earth mischmetal in Embodiments 3A and 3B are 500 ppm and 1500 ppm respectively, wherein the rare earth mischmetal in Embodiment 3B is added in two times, with 1000 ppm added for the first time, and 500 ppm addition after 3 minutes, and the temperature of the molten steel is controlled to be above 1530° C. before adding the rare earth mischmetal; and after rare earth addion, the RH deep vacuum time is not less than 12 min, and the soft blowing time after breaking vacuum is not less than 15 min.

(3) The molten steel is poured into an ingot mold, cooled and solidified into an ingot.

(4) The ingot is forged to prepare a metal bar with diameters of 100-350 mm, and its composition (shown in Table 4), structure and properties are tested.

TABLE 4

Composition of steels of Comparative Example 3 and Embodiment 3

| Steel | C | Si | Mn | Cr | Mo | V | P | T[S] | T[RE] | T[O] |
|---|---|---|---|---|---|---|---|---|---|---|
| Comparative Example 3 | 0.25-0.60 | 0.95-1.1 | 0.3-0.45 | 4.5-5.5 | 1.2-1.6 | 0.8-1.1 | ≤0.02 | ≤0.005 | — | ≤12 |
| Embodiment 3A | 0.25-0.60 | 0.95-1.1 | 0.3-0.45 | 4.5-5.5 | 1.2-1.6 | 0.8-1.1 | ≤0.02 | ≤0.005 | 0.042 | ≤12 |

TABLE 4-continued

Composition of steels of Comparative Example 3 and Embodiment 3

| Steel | C | Si | Mn | Cr | Mo | V | P | T[S] | T[RE] | T[O] |
|---|---|---|---|---|---|---|---|---|---|---|
| Embodiment 3B | 0.25-0.60 | 0.95-1.1 | 0.3-0.45 | 4.5-5.5 | 1.2-1.6 | 0.8-1.1 | ≤0.02 | ≤0.005 | 0.102 | ≤50 |

Note:
all the components except O being in ppm by weight are in % by weight in Table 4, and the balances are Fe and inevitable impurity elements. In Comparative Embodiment 3, no rare earth elements are added.

High brightness rare earth-rich nanoclusters ranging in sizes from 2 to 25 nm and from 25 to 50 nm are observed experimentally in samples of Embodiment 3A (residual amount of rare earth elements is 420 ppm) and Embodiment 3B (residual amount of rare earth elements is 1020 ppm), respectively, by the characterization of high-resolution High Angle Annular Dark Field (HAADF) of a spherical aberration-corrected electron transmission microscope. The high-resolution images show that these nanoclusters are isostructural with the bcc matrix but have obvious lattice distortion to the Fe matrix.

By performing phase transition point tests on the samples of Embodiments 3 and 3B described above, it is found that the diffusion-type phase transition temperature changes by 15° C. and 40° C., respectively.

Embodiment 4

A rare earth microalloying method for high-end bearing steel has a production process route being LF smelting→RH refining→continuous casting→rolling, including the following steps.

(1) The slag system is reasonably adjusted, and the slag alkalinity is more than 6; during the LF refining, it ensures white slag time more than 15 min, stable slag alkalinity not less than 5, the total oxygen content T[O] not more than 15 ppm and the total sulfur content T[S] less than 0.003% by using Al pre-deoxidation.

(2) In the RH refining, the components are not adjusted as much as possible, and all the component adjustments shall be completed at LF station; after RH vacuum treatment for 10 min, a high-purity rare earth mischmetal (T[O]r<60 ppm in the rare earth mischmetal) is added into the overhead storage bin, and the addition amount of the high-purity rare earth mischmetal satisfies WRE>α×T[O]+T[S], wherein a is a correction coefficient and the value is 6-30, preferably 8-20; T[O] is the total oxygen content in the steel, and T[S] is the total sulfur content in the steel; after the addition of the high-purity rare earth mischmetal, the RH deep vacuum cycle time is guaranteed to be more than 10 min, and the soft blowing time of Ar gas is guaranteed to be more than 20 min; the formed rare-earth oxysulfides/rare-earth sulfides is partially floated to reduce the number of inclusions; the superheat is controlled between 25° C. and 40° C., and the superheat control is increased by 5° C. to 10° C. compared with the conventional superheat control so as to prevent nozzle clogging; and the Al content at the end point of RH refining is controlled between 0.015% and 0.030%.

(3) High-purity rare earth mischmetal is added by selecting the subsequent furnace of the whole pouring, and the rare earth in Embodiments 4A, 4B, and 4C are added in amounts of 100 ppm, 500 ppm, and 1200 ppm, respectively, in which the rare earth of Embodiment 4C being added in two times, with 700 ppm added in the first time, and 500 ppm in the second time, at an interval of 4 minutes.

(4) The gas tightness between the big ladle-tundish-crystallizer and the thickness of the liquid surface covering agent of the tundish are strengthened in continuous casting; the argon purging of the tundish liquid surface is strengthened to avoid air suction in the continuous casting process; the amount of nitrogen increase is controlled within 5 ppm in the whole continuous casting process, inhibiting the formation of TiN inclusions and ensuring the purity of the steel; the content of MgO in the working layer of the tundish is controlled to be more than 85%; the $SiO_2$ content of a ladle shroud, a tundish stopper and a submerged nozzle is less than 5%, so as to ensure the compactness and corrosion-resistance of the tundish and the anti-scouring and erosion resistance of the three-major-items; and continuous casting is performed at a constant casting speed, then rolled into a rectangular billet with a diameter of 320*480 mm.

(5) The rectangular continuous casting billet is heated to 1150-1250° C., passed through a continues rolling mill and rolled into bars with diameters of 90-210 mm; and it is sampled for composition testing (shown in Table 5).

TABLE 5

Composition of steels of Comparative Example 4 and Embodiment 4

| Steel | C | Si | Mn | Cr | P | T[S] | T[RE] | T[O] |
|---|---|---|---|---|---|---|---|---|
| Comparative Example 4 | 0.9-1.1 | 0.15-0.35 | 0.25-0.45 | 1.4-1.65 | ≤0.01 | ≤0.005 | — | ≤40 |
| Embodiment 4A | 0.9-1.1 | 0.15-0.35 | 0.25-0.45 | 1.4-1.65 | ≤0.01 | ≤0.005 | 0.007 | ≤40 |
| Embodiment 4B | 0.9-1.1 | 0.15-0.35 | 0.25-0.45 | 1.4-1.65 | ≤0.01 | ≤0.005 | 0.035 | ≤40 |
| Embodiment 4C | 0.9-1.1 | 0.15-0.35 | 0.25-0.45 | 1.4-1.65 | ≤0.01 | ≤0.005 | 0.098 | ≤40 |

Note:
all the components except O being in ppm by weight are in % by weight in Table 5, and the balances are Fe and inevitable impurity elements. In Comparative Embodiment 4, no rare earth elements are added.

For analytical test of the rolled materials with the four components above, the size of the rare earth-rich nanoclusters and the change of the diffusion-type phase transition temperature are shown in Table 6. It can be seen that, with the increase of the residual rare earth elements T[RE] in the steel, the size of the rare earth-rich nanoclusters increases, the influence on the diffusion-type phase transition points increases, and the temperature of the phase transition correspondingly increases.

TABLE 6

Analytical Test Results

| Steel | Rare earth-rich nanocluster diameter (nm) | Change in diffusion type phase transition point (° C.) | T[RE] |
|---|---|---|---|
| Comparative Example 4 | — | — | — |
| Embodiment 4A | 1-5 | 2 | 0.007 |
| Embodiment 4B | 5-20 | 25 | 0.035 |
| Embodiment 4C | 20-50 | 60 | 0.098 |

Embodiment 5

A rare earth microalloying method for high-quality stainless steel has a production process route being LF smelting→VD refining→ingot casting→forging, including the following steps.

(1) The alloy composition is adjusted at the LF station. The slag alkalinity is controlled to be more than 3, and the white slag is kept for more than 35 min, so as to carry out deep deoxidation and desulphurization, making the total oxygen content not more than 25 ppm and the total sulfur content not more than 30 ppm.

(2) After LF refining, a rare earth mischmetal (T[O]r<60 ppm in the rare earth mischmetal) is rapidly added into the ladle via the slag surface before VD treatment; the addition amounts of the rare earth in Embodiments 5A and 5B are 400 ppm and 750 ppm, respectively; and after adding the rare earth mischmetal, the deep vacuum time of VD is 15 min, and the soft blowing time after breaking VD vacuum is 25 min.

(3) The molten steel is respectively poured into ingot molds of 5-30 t in weight, cooled and solidified into ingots.

(4) The ingot is subjected to forging processing to prepare a rectangular billet having a cross-sectional size of 280×450 mm, and its composition (shown in Table 7) and properties (shown in Table 8) are tested.

TABLE 7

Composition of steels of Comparative Example 5 and Embodiment 5

| Steel | C | Si | Mn | Cr | P | T[S] | T[RE] | T[O] |
|---|---|---|---|---|---|---|---|---|
| Comparative Example 5 | 0.25-0.4 | 0.3-0.6 | 0.4-0.65 | 11-15 | ≤0.02 | ≤0.003 | — | ≤30 |
| Embodiment 5A | 0.25-0.4 | 0.3-0.6 | 0.4-0.65 | 11-15 | ≤0.02 | ≤0.003 | 0.032 | ≤30 |
| Embodiment 5B | 0.25-0.4 | 0.3-0.6 | 0.4-0.65 | 11-15 | ≤0.02 | ≤0.003 | 0.067 | ≤25 |

Note:
all the components except O being in ppm by weight are in % by weight in Table 7, and the balances are Fe and inevitable impurity elements. In Comparative Embodiment 5, no rare earth elements are added.

For analytical test of the rolled materials with the three components above, the size of the rare earth-rich nanoclusters and the change of the diffusion-type phase transition temperature are shown in Table 8. It can be seen that the size of the rare earth-rich nanoclusters tends to increase with the increase of the residual amount T[RE] of rare earth elements in the steel; and the influence on the diffusion-type phase transition points increases, and the temperature of the phase transition increases accordingly. The size of the rare earth-rich nanoclusters is directly proportional to the residual amount T[RE] of rare earth elements in the steel. However, the size of the rare earth-rich nanoclusters tends to decrease with the increase of the total oxygen content in the steel, the relationship between them is in inverse ratio.

TABLE 8

Analytical Test Results

| Steel | Rare earth-rich nanocluster diameter (nm) | Change in diffusion type phase transition point (° C.) | T[RE] | T[O] |
|---|---|---|---|---|
| Comparative Example 5 | — | — | — | ≤30 ppm |
| Embodiment 5A | 4-15 | 12 | 0.032 | ≤30 ppm |
| Embodiment 5B | 15-42 | 23 | 0.067 | ≤25 ppm |

The above embodiments are merely preferred embodiments of the present application and are not to be construed as limiting the scope of the present application. It should be noted that those skilled in the art can make various changes, substitutions and alterations herein which fall in the scope of protection of this application without departing from the spirit and scope of the invention.

The invention claimed is:

1. A rare-earth microalloyed steel, wherein the steel has a microstructure comprising rare earth-rich nanoclusters with diameters of 1-50 nm, the rare earth-rich nanoclusters having the same crystal structure type as a matrix are nano-scale particle groups formed by an aggregation of several to hundreds of rare earth atoms, and the diameters of the rare earth-rich nanoclusters are directly proportional to a residual amount $T_{RE}$ of rare earth elements in the steel, but inversely proportional to a total oxygen content in the steel;

wherein the rare-earth microalloyed steel is prepared by a process comprising:

controlling a total oxygen content $T_{[O]m}$ of molten steel to be within 50 ppm, $T_{[S]}$≤50 ppm, where $T_{[S]}$ is a total sulphur content in the steel;

controlling a total oxygen content of a rare earth metal added in the molten steel to be less than 60 ppm;

controlling a temperature of the molten steel to exceed its liquidus line $T_m$+(20-100)° C. when adding the rare earth metal; and controlling a deep vacuum cycle time after the addition of the rare earth metal to be more than 10 min and an Ar gas soft blowing time to be more than 15 min.

2. The rare-earth microalloyed steel according to claim 1, wherein the vacancies in the Fe matrix form rare earth-vacancy pairs with a number of rare earth atoms, so that a number of rare earth atoms around the vacancies are regularly arranged, thereby forming a microstructure of rare earth-rich nanoclusters, and the presence of a single Fe vacancy helps stabilize local rare earth-rich nanoclusters consisting of up to 14 rare earth atoms.

3. The rare-earth microalloyed steel according to claim 1, wherein the rare earth-rich nanoclusters have diameters of 2-50 nm.

4. The rare-earth microalloyed steel according to claim 1, wherein the residual amount $T_{RE}$ of rare earth elements in the microalloyed steel is 30-1000 ppm.

5. The rare-earth microalloyed steel according to claim 1, wherein the residual amount $T_{RE}$ of rare earth elements in the microalloyed steel is 30-600 ppm.

6. The rare-earth microalloyed steel according to claim 1, wherein the residual amount $T_{RE}$ of rare earth elements in the microalloyed steel is 50-500 ppm.

7. The rare-earth microalloyed steel according to claim 1, wherein a change in an initial temperature of a diffusion type phase transition of the rare-earth microalloyed steel satisfies the following table:

| Types | Change in initial temperature of phase transition/° C. |
|---|---|
| Plain carbon steel | At least 2° C. |
| Low alloy steel with an alloy content of not more than 10 wt % | At least 5° C. |
| Medium-high alloy steel with an alloy content of more than 10 wt %. | At least 10° C. |

8. The rare-earth microalloyed steel according to claim 7, wherein the change in the initial temperature of the phase transition of the rare-earth microalloyed steel satisfies the following table:

| Types | Change in initial temperature of phase transition/° C. |
|---|---|
| Plain carbon steel | 10-50° C. |
| Low alloy steel with an alloy content of not more than 10 wt % | 20-60° C. |
| Medium-high alloy steel with an alloy content of more than 10 wt %. | 25-60° C. |

9. The rare-earth microalloyed steel according to claim 7, wherein an initial temperature of ferrite phase transition in rare-earth microalloyed plain carbon steel decreases by 20-50° C.; and an initial temperature of bainite transformation in rare-earth microalloyed low alloy steel decreases by 30-60° C.

10. The rare-earth microalloyed steel according to claim 7, wherein the number and diameters of the rare earth-rich nanoclusters in the rare-earth microalloyed steel are directly proportional to the change of the initial temperature of the phase transition.

11. A process for controlling the rare-earth microalloyed steel according to claim 1, comprising the steps of:

(1) controlling a total oxygen content $T_{[O]m}$ of molten steel to be within 50 ppm, and $T_{[S]} \leq 50$ ppm;

(2) adding a rare earth metal with a total oxygen content of less than 60 ppm into the molten steel, wherein the addition amount of the rare earth metal satisfies $W_{RE} > \alpha \times T_{[O]m} + T_{[S]}$, and the value of $\alpha$ is 6-30; $T_{[O]m}$ is the total oxygen content in the steel, and $T_{[S]}$ is the total sulphur content in the steel; controlling the temperature of the molten steel to exceed its liquidus line $T_m$+(20-100)° C. when adding the rare earth metal; controlling the deep vacuum cycle time after the addition of the rare earth metal to be more than 10 min and the Ar gas soft blowing time to be more than 15 min; and (3) protecting the molten steel containing the rare earth metal from air to control the residual amount $T_{RE}$ of the rare earth metal in the liquid steel to be 30-1000 ppm.

12. The process for controlling the rare-earth microalloyed steel according to claim 11, wherein the total oxygen content $T_{[O]m}$ in step (1) to be up to 25 ppm.

13. The process for controlling the rare-earth microalloyed steel according to claim 11, wherein the value of $\alpha$ is 8-20 in step (2); the rare earth metal is added in one step or step by step in two or more steps, wherein the time interval between the two or more steps of rare earth addition is not less than 1 minute and not more than 10 minutes.

14. The rare-earth microalloyed steel according to claim 2, wherein the rare earth-rich nanoclusters have diameters of 2-50 nm.

15. The rare-earth microalloyed steel according to claim 2, wherein the residual amount $T_{RE}$ of rare earth elements in the microalloyed steel is 30-1000 ppm.

16. The rare-earth microalloyed steel according to claim 2, wherein the residual amount $T_{RE}$ of rare earth elements in the microalloyed steel is 30-600 ppm.

17. The rare-earth microalloyed steel according to claim 2, wherein the residual amount $T_{RE}$ of rare earth elements in the microalloyed steel is 50-500 ppm.

18. The rare-earth microalloyed steel according to claim 2, wherein a change in an initial temperature of a phase transition of the rare-earth microalloyed steel satisfies the following table:

| Types | Change in initial temperature of phase transition/° C. |
|---|---|
| Plain carbon steel | At least 2° C. |
| Low alloy steel with an alloy content of not more than 10 wt % | At least 5° C. |
| Medium-high alloy steel with an alloy content of more than 10 wt %. | At least 10° C. |

19. The process for controlling the rare-earth microalloyed steel according to claim 12, wherein the value of $\alpha$ is 8-20 in step (2); the rare earth metal is added in one step or step by step in two or more steps, wherein the time interval between the two or more steps of rare earth addition is not less than 1 minute and not more than 10 minutes.

20. The process of claim 11, wherein the vacancies in the Fe matrix form rare earth-vacancy pairs with the number of rare earth atoms, so that the number of rare earth atoms around the vacancies are regularly arranged, thereby forming the microstructure of rare earth-rich nanoclusters, and the presence of a single Fe vacancy helps stabilize local rare earth-rich nanoclusters consisting of up to 14 rare earth atoms.

* * * * *